US005511331A

United States Patent [19]

Morosini

[11] Patent Number: 5,511,331

[45] Date of Patent: Apr. 30, 1996

[54] CODED MARKER SUPPORTS AND DEVICE FOR A POSITIONING OF CODED MARKERS

[76] Inventor: Flavio Morosini, 18, rue du Rouvion, F-54800 Hatrize, France

[21] Appl. No.: 243,969

[22] Filed: May 17, 1994

Related U.S. Application Data

[63] Continuation of Ser. No. 752,696, filed as PCT/FR90/00144, Mar. 2, 1990, abandoned.

[30] Foreign Application Priority Data

Mar. 3, 1989 [FR] France ..... 89 02795
Feb. 28, 1990 [IT] Italy ..... 43510/90

[51] Int. Cl.[6] ..... G09F 3/00

[52] U.S. Cl. ..... 40/316; 40/663; 40/666

[58] Field of Search ..... 40/306, 316, 322, 40/5, 666, 622, 640, 658, 663; 434/171, 172, 406, 407

[56] References Cited

U.S. PATENT DOCUMENTS

| | | | |
|---|---|---|---|
| 1,612,035 | 12/1926 | Lorenzo | 40/622 |
| 1,794,379 | 3/1931 | Horix | 40/622 |
| 2,067,526 | 1/1937 | Graham | 40/622 X |
| 4,011,676 | 3/1977 | Ritter | 40/622 |
| 4,322,902 | 4/1982 | Lenthall | 40/622 X |
| 5,078,829 | 1/1992 | Morosini . | |
| 5,117,570 | 6/1992 | Morosini . | |

FOREIGN PATENT DOCUMENTS

| | | | |
|---|---|---|---|
| 0076437 | 9/1961 | France . | |
| 2344992 | 10/1977 | France . | |
| 474129 | 7/1969 | Switzerland | 40/316 |
| 2028761 | 3/1980 | United Kingdom | 40/316 |
| 2070558 | 9/1981 | United Kingdom | 40/316 |

*Primary Examiner*—Brian K. Green
*Attorney, Agent, or Firm*—Horst M. Kasper

[57] ABSTRACT

A coded marker support and a device for positioning of coded markers comprising a marking support (43), which is comprised of a plate (5) on which a plurality of aligned identification elements (1) may be locked. In an alternate embodiment, the plate (5 ) is provided with clamping members (10) allowing to fix the marking support (43) to a cable, the plate (5) being substantially parallel to the cable.

24 Claims, 3 Drawing Sheets

CODED MARKER SUPPORTS AND DEVICE FOR A POSITIONING OF CODED MARKERS

This is a continuation of application Ser. No. 07/752,696, filed as PCT/FR90/00144, Mar. 2, 1990, now abandoned.

BACKGROUND OF THE INVENTION

1. Field of the Invention

It is an object of the invention to provide coded marker supports and a device for positioning coded markers.

2. Brief Description of the Background of the Invention, Including Prior Art

In order to mark insulated or bundled electrical cables, it is known to utilize markers formed by a combination of alphanumerical characters assembled on a marker support. These characters are formed in general by soft, pliable and elastic tubular end pieces which carry a character or a numeral. They are placed and introduced in rows in a seat or housing socket of the marker support. According to a current embodiment, the seat for the marker support is formed by a cover piece having two longitudinal sections. One of the sections is intended for the placement of a marker, and the second section serves to slide the marker support on a cable or allows the fastening of the marker support to a cable by means of an auxiliary attachment member.

The utilization of these tubular characters mentioned above, for the positioning of markers is associated with the inconvenience that these tubular characters are not adapted to the quick positioning of a series of markers.

SUMMARY OF THE INVENTION

1. Purposes of the Invention

It is an object of the invention to provide marker supports and a device for the positioning of the coded markers on such marker supports, which are not associated with this inconvenience.

2. Brief Description of the Invention

These and other objects and advantages of the present invention will become evident from the description which follows.

A marker support includes an elongated support bar subdivided in its elongation direction into a plurality of sequential parallelograms. Each one of the sequential parallelograms is defined by a recess having a bottom shaped like a parallelogram and having a top shaped like a parallelogram. An area of the top parallelogram is larger than an area of the bottom parallelogram. Wall sections between the top parallelogram and the bottom parallelogram are inclined such that the recess converges toward the bottom of the recess. An aperture is located in the bottom of each of the recesses. A respective one of a plurality of identification element is disposed in sequence in a respective one of a plurality of the recesses. The aperture of the bottom of each of the recesses is aligned for receiving a locking projection attached to a respective identification element for locking a respective one of the plurality of identification elements to the elongated support bar.

The recesses can have a trapezoidal cross-section in symmetry planes of the recesses disposed perpendicular to a horizontal plane of the recess.

The top parallelogram and the bottom parallelogram can be rectangular and the projection can be of rotation symmetry.

An elongated support bar is subdivided in its elongation direction into a plurality of sequential parallelograms. Each one of the sequential parallelograms is defined by a recess having a trapezoidal cross-section in symmetry planes disposed perpendicular to a top surface of a plane of the parallelograms. A bottom of the recess is shaped like a parallelogram. A top of the recess has a shape of a parallelogram. An area of a top parallelogram is larger than an area of a bottom parallelogram. Wall sections between the top parallelogram and the bottom parallelogram are inclined such that the recess converges toward the bottom of the recess. An aperture is located in the bottom of each of the recesses. A respective one of a plurality of identification elements is to be placed in sequence of a plurality of recesses. The aperture is aligned for receiving a locking projection attached to a respective identification element of the plurality of identification elements for locking a respective one of the plurality of identification elements to the elongated support bar.

According to the invention, a marker support for supporting a marker, formed by at least two aligned identification elements, comprises an oblong plate, comprising at least two aligned locking members for fastening respectively two identification elements to the plate, where each identification element has a locking and fastening member matching a locking member of the plate.

According to one feature of the invention, the plate comprises on one of its faces seating means for receiving each identification element in a defined position.

According to another feature of the invention, the plate comprises on its other face at least one elastic, gripping and clamping member for gripping a cable. Advantageously, the plate forms a small bar connected to the clamping members by one of its ends.

According to the invention, there is moreover disclosed a device for the positioning of coded markers formed by at least two aligned identification elements which comprise:

a comb having a back, where from said back there extends at least one row of parallel teeth which are spaced by a step P, where each tooth has a face furnished with at least two aligned locking members. The locking members of one row of teeth are disposed along lines perpendicular to the teeth, and a plurality of bands each formed by a plurality of identification elements connected to each other, and each having a locking member which compliments and matches a locking member of a tooth. The locking members of one band are spaced by a step P.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
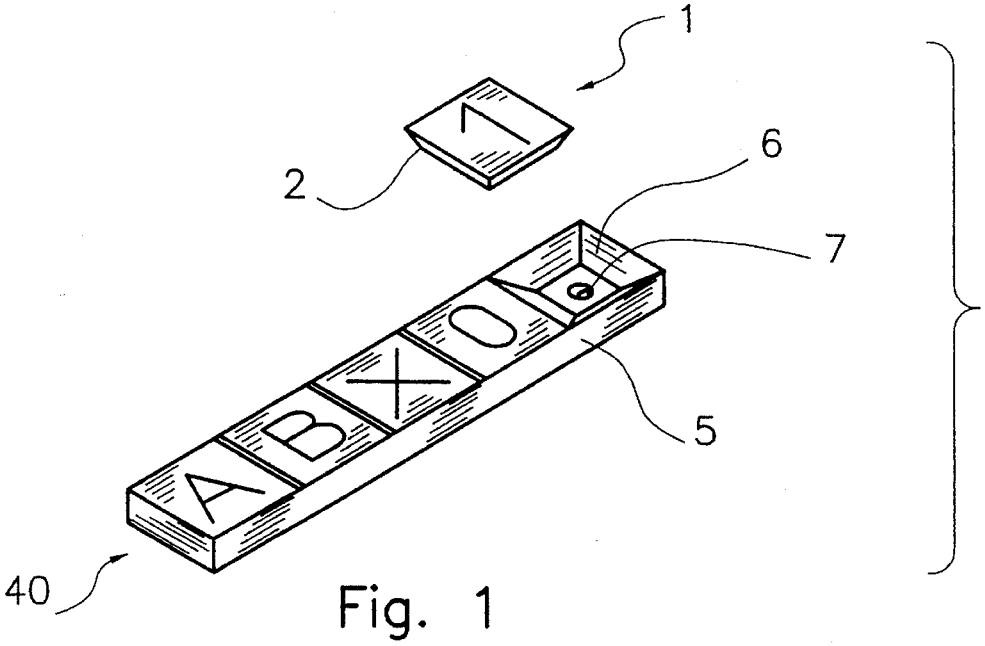
FIG. 1 is a perspective view of a marker support intended to support the marker formed by five identification elements.
Figure 2:
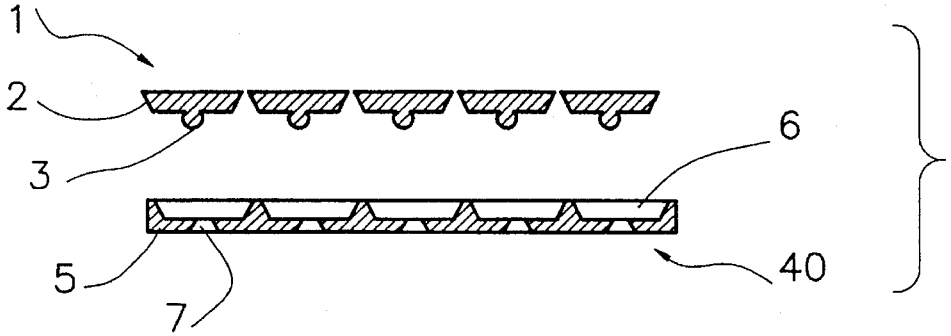
FIG. 2 is a sectional view along a longitudinal center plane of a marker support and of five identification elements.

The marker supports illustrated in the figures are intended to allow the assembly of five aligned identification elements 1, forming a marker, where this number is an arbitrary number of identification elements. As can be seen in FIGS. 1 and 2, an invention identification element 1 comprises a body 2 having a first face. A male locking member 3 projects at the center of the first face of the body 2. A second face of the body 2, disposed opposite to the preceding first face, is inscribed with a distinctive sign. According to the illustrated example, the body 2 of the identification element 1 has the form of a frustum of a pyramid. A numeral or a character is inscribed on the base of the frustum of the pyramid. The locking member 3 is of a spheroidal shape.

A first embodiment of a marker support according to the invention is illustrated in FIGS. 1 and 2. This marker support 40 is formed by a rectangular plate 5, which comprises five contiguously aligned small cavity pockets 6. Each of the cavity pockets has a shape matching the shape of the body 2 of an identification element 1, allowing to clamp the identification element in a defined position. At the level of each small cavity pocket 6, the plate 5 comprises additionally a female locking member matching the locking member of the identification element 1. According to the illustrated example, this locking member is delimited by a conical hole 7, punched at the center of the bottom of a small cavity pocket 6 and becoming wider starting from the the small cavity pocket. The diameter of the hole 7, at the level of the bottom of the small cavity pocket 6, is slightly smaller relative to the diameter of the spheroidal protrusion of the locking member 3 of an identification element 1. The material of the marker support 40 is chosen to be sufficiently elastic in order to allow the locking of an identification element 1 in a small cavity pocket 6 by application of a simple pressure. Thus, the identification element 1 is fastened to the marker support 40.

The marker support 40 illustrated in FIGS. 1 and 2 is intended to be fixed on an object to be identified. If this object is a cable of a small diameter, then it can be introduced into a standard tubular marking support.

Figure 3:
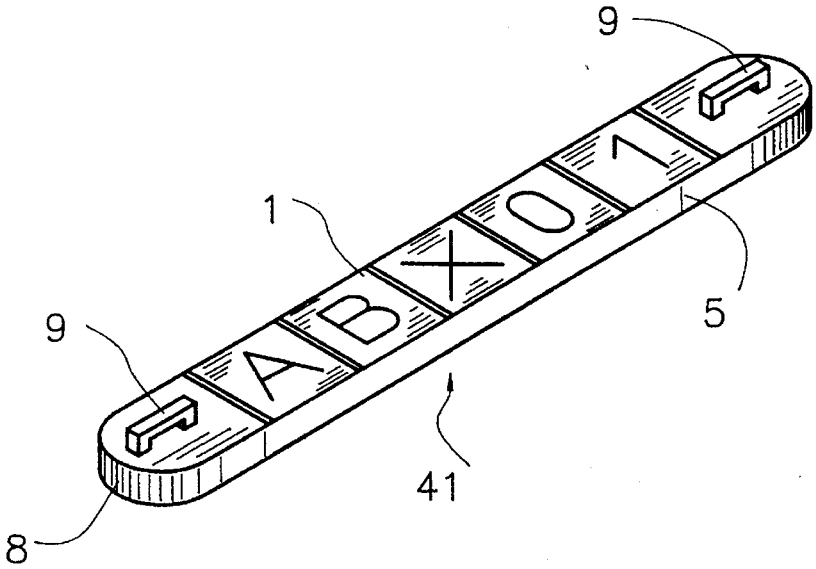
FIG. 3 is a perspective view of a second marker support according to the invention.

A second embodiment of a marker support according to the invention is illustrated in FIG. 3. This marker support 41, is distinguished from the marker support described above, in that the plate 5 is extended at each of its ends and comprises a trigger handle 9, allowing the passage of a linkage where a trigger handle 9 projects on each of the extended ends.

Figure 4:
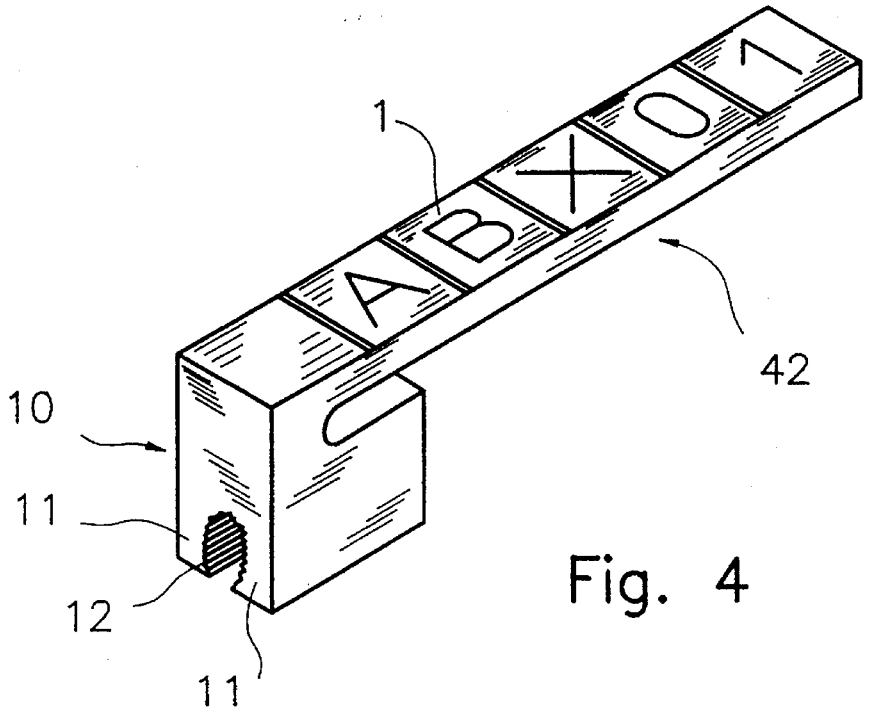
FIG. 4 is a perspective view of a third marker support according to the invention.

The marker support 42, illustrated in FIG. 4, comprises a plate 5, identical to the plate described with respect to FIG. 1, and an elastic clamping member 10. The clamping member 10 projects and overhangs at one end of the plate 5 and is disposed on the side of plate 5 opposite to the side of the small cavity pockets 6. The clamping member 10 comprises two serrated, indented clamping jaw 11 separated by a slot or hole 12 where the longitudinal axis of the hole 12 is disposed parallel to the longitudinal axis of the plate 5. This arrangement allows the fixing and fastening of the support on a cable in such a way that the plate 5 extends substantially parallel to the cables. The elasticity of the clamping member 10, by which the clamping jaws 11 are returned to their rest position, is obtained by the choice of an appropriate material for making the support 42. It is noted that the connection between the clamping member 10 and the plate 5 is furnished at the level of an extension of this plate. According to this construction, it is possible to fit a transparent protection cover over tightly the plate 5, which protection cover covers the marker completely.

Figure 5:
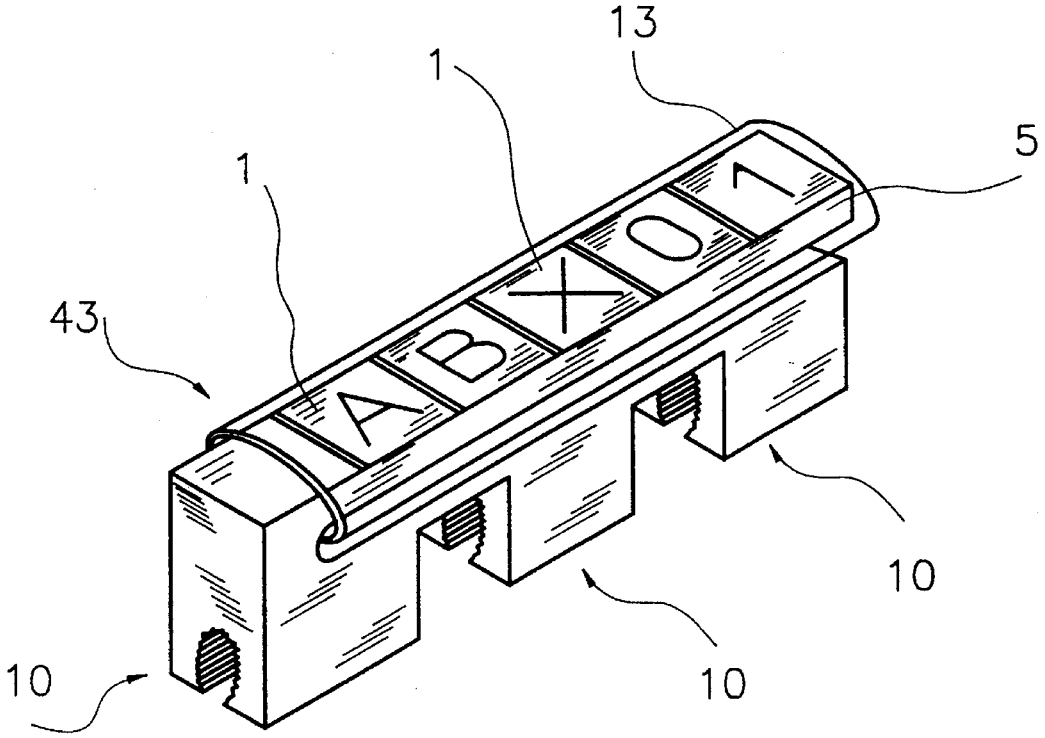
FIG. 5 is a perspective view of a fourth marker support according to the invention, carrying a protection cover.

Another embodiment of the marker support 43 is illustrated in FIG. 5. Compared to the marker support 42 illustrated in FIG. 4, the embodiment of the marker support 43 of FIG. 5 includes three aligned elastic clamping members 10. These three clamping members are joined and integral and are connected to the plate 5 itself only via one of their end sections. In this way, the plate 5 remains completely clear and free relative to the remainder of the marker support and it can be covered by a transparent cover 13 which protects the identification elements 1, supported on the plate 5.

According to a further embodiment, not illustrated, of the marker support 43 illustrated in FIG. 5, the clamping members 10 are integral with the plate 5 and the marker support comprises two grooves which extend laterally along the two longitudinal sides of the marker. These grooves allow locking and snapping in of a transparent cap covering the marker. Advantageously, provisions are made to produce the protection elements by rearranging several cover caps of this type, where the cover caps are connected to each other by their longitudinal edges by means of connection elements, which are preferably divisible at a breaking seam. The protection elements allow to assemble several marker supports.

Figure 6:
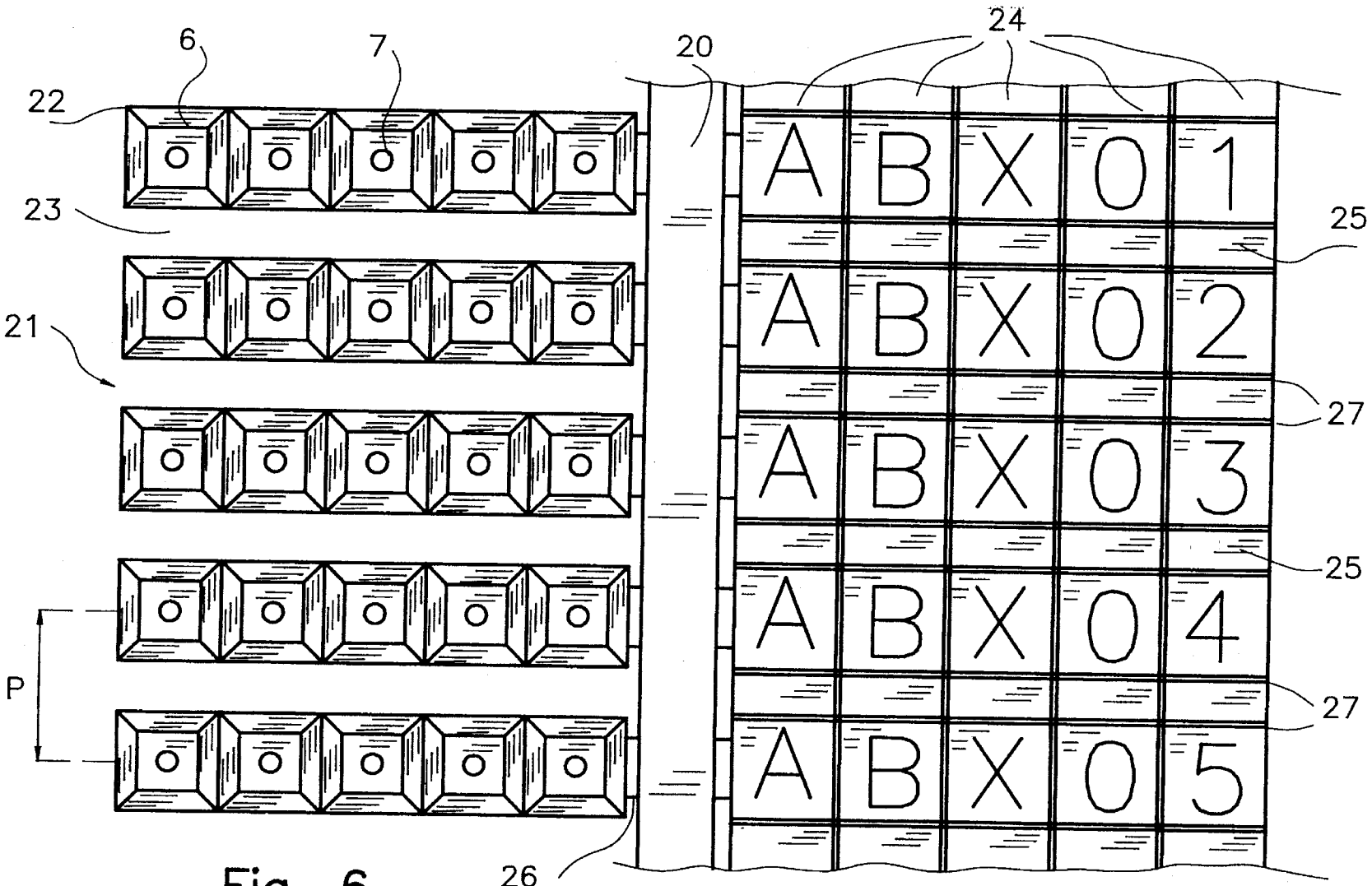
FIG. 6 is a top view of a portion of a device for the positioning of the coded markers formed by five aligned identification elements.

In large electrical installations, it is frequently necessary to use a large number of markers for marking the cables or the bundles of cables. In order to allow a quick placing and positioning of a large number of markers, the device according to FIG. 6 is disclosed according to the invention. This device according to FIG. 6 comprises a comb with a rectangular back 20. Two or more rows 21 of teeth 22, spaced relative to the centers of the rows 21 by a step P and disposed perpendicular to the back 20, extend in opposite directions from the back 20. These teeth can be quasi abutting or can, as shown in the exemplified embodiment, be separated by an opening 23. The teeth are individually formed by one of the marker supports described above. According to the illustrated example, the teeth 22 are congruent with the support 40 described in connection with FIG. 1. Consequently, according to this arrangement, the small cavity pockets 6 and the locking members 7 are placed along lines parallel to the back 20. The device for placing and positioning of the coded markers according to the invention comprises additionally bands 24. These bands 24 are each formed by a plurality of identification elements 1, where the identification elements are connected to each other by those of their sides furnished to be facing the lateral sides of a marker support, in the mounted and assembled state. If the teeth 22 are separated by an opening 23, then the identification elements 1 of each band 24 are connected by intermediary elements or junction strips 25, where the length of junction strips 25 is equal to the length of the intermediate opening 23. In this way, the identification elements 1 of each band exhibit a repetition distance of a step P. The signs carried by the identification elements 1 of a same band can be identical or different and, in the latter case, they can be arranged according to any type of progression suitable for the coding. For example, one band can comprise a sequence of series of increasing numerals (0, 1, . . . 8, 9), or increasing double numerals (0, 0, 1, 1, . . . 9, 9), or characters succeeding in alphabetical order and the like.

In order to position a series of markers with the aid of this device, it is sufficient to lock the suitably selected bands 24 on a row 21 of teeth 22 of the comb, as it is illustrated for the row on the right-hand side of FIG. 6, and where one band is arranged relative to the other in order to form the desired markers. Once the markers are formed, it remains to separate the pertinent row 21 of teeth 22 from the comb, as well as to separate the teeth 22 themselves. In order to facilitate this operation, a weakened zone 26 is disclosed at the level of the attachment of each tooth 22 at the back 20 of the comb, as well as a weakened zone 27 on each side of the junction strips 25. These junction strips 25 can besides be replaced by a simple linkage or by a pair of linkages. Depending on the nature of material used for producing the comb 20, 22 and the bands 24, one uses a sharp tool for shearing the weakened zones 26, 27, or one proceeds to fold the elements back and forth in order to separate one element from the other.

The invention is not limited to the embodiments which are described and it is possible to make variations of these embodiments. In particular, when the marks, carried by identification elements 1, are not of the character kind, for example, in case of color signs, it is not necessary to furnish a wedge fastening where, for example, the angular pieces are interlocked, in order to prevent a pivoting of the identification elements relative to the marker support. When this is the case, this fastening can be carried out without any particular fastening means by a simple side-by-side positioning of the identification elements having one side surface plane in contact, for example, where the square identification elements are locked and snapped onto marker supports in an abutting way, or by furnishing locking members which do not form a pivot.

I claim:

1. A marker support (40, 41, 42, 43) for supporting a marker comprising an oblong plate (5) having at least two contiguously aligned recesses (6) having the shape of frustums of pyramids, wherein bases of the frustums of pyramids form a top plane of the oblong plate (5) and wherein a length of a side of the bases is equal to a width of the oblong plate (5), and wherein a locking member (7) formed by a conical hole is provided in a center of a bottom of each of the recesses (6);

at least two aligned identification elements (1), wherein each of the identification elements has a shape of a frustum of a pyramid matching a shape of each of the recesses (6) and includes a locking projection (3) attached to a face disposed opposite to a base of each of the identification elements, wherein each of the identification elements is fixed to the oblong plate (5) by means of the locking projection (3) formed by a spheroidal protrusion, matching the respective locking member (7) of the oblong plate (5) and wherein the base of each of the identification elements is inscribed with a distinctive sign.

2. The marker support (40, 41, 42, 43) according to claim 1, wherein the plate (5) comprises the recesses (6) on one of its faces for receiving each of the identification elements in a defined and fixed position.

3. The marker support (42, 43) according to claim 2 for an identification of cables, wherein the oblong plate (5) comprises on its other face at least one elastic clamping member (10) for clamping a cable.

4. The marker support (42, 43) according to claim 3, wherein the plate (5) forms a bar connected to the at least one elastic clamping member (10) by one of its ends.

5. The marker support according to claim 1, wherein the oblong plate is subdivided in its elongation direction into a plurality of sequential parallelograms, wherein each one of the plurality of sequential parallelograms is defined by the recess having the shape of frustums of pyramids and forming a parallelogram-shaped bottom and a parallelogram-shaped top, wherein an area of the parallelogram-shaped top is larger than an area of the parallelogram-shaped bottom, and wherein wall sections between the parallelogram-shaped top and the parallelogram-shaped bottom are inclined such that the recess converges toward the parallelogram-shaped bottom of the recess, and wherein the conical hole is located in the parallelogram-shaped bottom of the recess;

wherein a respective one of the identification elements is disposed in sequence in a respective one of the recesses, and wherein the conical bole of the parallelogram-shaped bottom of each of the recesses is aligned for receiving the locking projection attached to a respective one of the identification elements for locking the respective one of the identification elements to the oblong plate.

6. The marker support according to claim 5, wherein the locking projection is formed by a spherical head.

7. The marker support according to claim 5, wherein the recess has a trapezoidal cross-section in symmetry planes disposed perpendicular to a horizontal plane of the recess.

8. The marker support according to claim 5 further comprising an end extension formed at an end of oblong plate;

a trigger handle attached to a top side of the end extension for allowing attachment of a linkage through the trigger handle.

9. The marker support according to claim 5, wherein the conical hole is formed of a frustro-conical shape having a narrow section, wherein the narrow section of the frustro-conical shape adjoining the parallelogram-shaped bottom of the recess such that the locking projection of the respective one of the identification elements locks in the frustro-conical shape of the conical hole.

10. The marker support according to claim 5, further comprising a clamping member formed at an end of the oblong plate and including two serrated, indented clamping jaws separated by a slot, wherein a horizontal plane defining the slot is disposed parallel to a plane corresponding to the oblong plate.

11. The marker support according to claim 5, wherein the parallelogram-Shaped top and the parallelogram-shaped bottom are rectangular and wherein the locking projection is of rotational symmetry.

12. The marker support according to claim 1, wherein the oblong plate is subdivided in its elongation direction into a plurality of sequential parallelograms, wherein each one of the sequential parallelograms is defined by the recess having the shape of frustums of pyramids and forming a trapezoidal cross-section in planes disposed perpendicular to a plane of the parallelograms, and wherein the bottom of the recess is shaped like a parallelogram and wherein a top of the recess has a shape of a parallelogram, wherein an area of a top parallelogram is larger than an area of a bottom parallelogram, and wherein wall sections between the top parallelogram and the bottom parallelogram are inclined such that the recess converges toward the bottom of the recess, and wherein the conical hole is located in the bottom of each of the recesses;

wherein a respective one of the identification elements is to be placed in sequence in a respective one of the recesses, and wherein the conical hole is aligned for receiving the locking projection attached to a respective one of the identification elements for locking a respective one of the identification elements to the oblong plate.

13. The marker support according to claim 1, wherein each one of the recesses is defined by a trapezoidal cross-section in planes disposed perpendicular to a horizontal plane of the recesses, and wherein a bottom of each of the recesses is shaped like a parallelogram and wherein a top of each of the recesses has a shape of a parallelogram, wherein an area of a top parallelogram is larger than an area of a bottom parallelogram and wherein wall sections between the top parallelogram and the bottom parallelogram are sloped such that each one of the recesses converges toward the bottom parallelogram of each of the recesses, and wherein the conical hole is located in the bottom parallelogram of each of the recesses;

a respective one of the identification elements is placed in the recesses, and wherein the the conical hole is aligned for receiving the locking projection attached to a respective one of the identification elements for locking the respective one of the identification elements to the oblong plate.

14. The marker support according to claim 13, wherein the locking projection is formed by a spherical head.

15. The marker support according to claim 13 further comprising an end extension formed at an end of the oblong plate;

a trigger handle attached to a top side of the end extension for allowing attachment of a linkage through the trigger handle.

16. The marker support according to claim 13, wherein the conical hole is formed of a frustro-conical shape with a narrow section of the frustro-conical shape adjoining the bottom parallelogram of the recess such that the respective locking projection of the respective identification element locks in the frustro-conical shape of the conical hole.

17. The marker support according to claim 13, further comprising a clamping member formed at an end of the oblong plate and including two serrated, indented clamping jaws separated by a slot, wherein a horizontal plane defining the slot is disposed parallel to a plane corresponding to the oblong plate.

18. The marker support according to claim 13, wherein the locking projection of each identification element is formed as a sphere, and wherein the conical hole is formed as a frustro-cone having an upper opening in each of the recesses allowing the locking projection to pass through and then to lock a respective one of the identification elements to the oblong plate, and wherein the oblong plate together with the identification elements forms a full bar with a substantially flat upper surface in the area of the recesses filled with the identification elements.

19. A device for preparing a positioning of coded markers comprising a comb having a rectangular back (20), wherein at least one row (21) of parallel teeth (22) extends along one of two longer sides of the rectangular back (20), and wherein the parallel teeth (22) are spaced from each other relative to their centers by a step P, where each tooth (22) forms an elongated support bar which comprises at least two sequential recesses each having a locking member (7) formed by a hole furnished in a bottom of each of the recesses, wherein the locking members (7) of teeth (22) are disposed aligned along lines disposed perpendicular to a longer side of the rectangular back (20), and a plurality of bands (24) connected to the rectangular back (20) at a side opposite to the parallel teeth (22), wherein each band (24) is formed by a plurality of identification elements (1), connected to each other and each including a spheroidal protrusion (3), matching the locking member (7) of a tooth (22), wherein spheroidal protrusions (3) of one band (24) are separated and spaced by a step P and wherein suitably selected bands (24) placed and fixed on rows (21) form a plurality of markers.

20. The device according to claim 19, wherein the teeth (22) are connected to the back (20) of the comb by a weakened zone (26).

21. The device according to claim 19, wherein the teeth (22) of the comb are not abutting in that the identification elements (1) following next to each other are connected bandlike by at least one divisible strip (25).

22. The device according to claim 19, wherein each tooth (22) of the comb (20) is formed by a marker support (40, 41, 42, 43) for supporting a marker wherein an oblong plate (5) is formed by the elongated support bar, wherein the recesses (6) each have a shape of a frustum of a pyramid and are disposed contiguously aligned, wherein bases of the frustums of pyramids form a top plane of the oblong plate (5) and wherein a length of a side of the bases is equal to a width of the oblong plate (5), and wherein the locking member (7) formed by the hole having a conical shape is provided in a center of the bottom of each of the recesses (6);

wherein each of the identification elements has a shape of a frustum of a pyramid matching the shape of each of the recesses (6) and includes a locking projection (3) formed by the spheroidal protrusion and attached to a face disposed opposite to a base of each of the identification elements, wherein each of the identification elements is fixed to the oblong plate (5) by means of the locking projection (3), matching the respective locking member (7) of the oblong plate (5) and wherein the base of each of the identification elements is inscribed with a distinctive sign, wherein the oblong plate (5) comprises cavity pockets formed by the recesses (6) on one of its faces for receiving each of the identification elements in a defined and fixed position.

23. The device according to claim 19, wherein each recess and each identification element have a shape of a frustum of a pyramid matching each other and wherein the identification elements are disposed immediately next to each other.

24. The device according to claim 19, wherein each identification element is furnished with a single spherical protrusion, wherein each spherical protrusion is formed by a ball attached to the respective identification element in a centered position and wherein the locking member is formed by a hole shaped as a frustum of a cone disposed in the elongated support bar forming an oblong plate with a tip of the frustum of the cone directed toward the identification element such that the ball will lock in the hole and be recessed relative to a face of the oblong plate opposite to the said hole of the oblong plate.

* * * * *